United States Patent [19]

Onaka et al.

[11] 4,450,809

[45] May 29, 1984

[54] IGNITION TIMING CONTROL SYSTEM FOR AN INTERNAL-COMBUSTION ENGINE

[75] Inventors: Hidemi Onaka; Nobuki Uchitani, both of Susono, Japan

[73] Assignee: Toyota Jidosha Kabushiki Kaisha, Toyota, Japan

[21] Appl. No.: 405,036

[22] Filed: Aug. 4, 1982

[30] Foreign Application Priority Data

Apr. 28, 1982 [JP] Japan ..... 57-72169

[51] Int. Cl.[3] ..... F02P 5/04; F02M 25/06

[52] U.S. Cl. ..... 123/421; 123/407

[58] Field of Search ..... 123/421, 406, 407, 408, 123/410

[56] References Cited

U.S. PATENT DOCUMENTS

| | | | |
|---|---|---|---|
| 3,804,326 | 4/1974 | McIntire | 123/421 |
| 3,812,832 | 5/1974 | Scott | 123/421 |
| 4,142,494 | 3/1979 | Nagi et al. | 123/407 |
| 4,181,106 | 1/1980 | Brakebill | 123/421 |
| 4,241,709 | 12/1980 | Schallmann et al. | 123/421 |
| 4,274,378 | 6/1981 | Tate | 123/421 |

*Primary Examiner*—Raymond A. Nelli

*Attorney, Agent, or Firm*—Kenyon & Kenyon

[57] ABSTRACT

An ignition timing control system for an engine using a vacuum advance unit connected to a distributor and communicated with an intake passage of the engine, which comprises: a throttle valve plate received within the intake passage; first and second ports formed in the wall of the intake passage; conduits connecting the first and second ports with the vacuum advance unit; and heat-sensitive valve means disposed in the conduit connecting the second port and the advance unit. The first port is located upstream of the valve plate and exposed to the substantially atmospheric pressure while the valve plate remains in its idle position, but exposed to the vacuum when the valve plate is opened from the idle position. The second port is kept located downstream of the valve plate and exposed to the vacuum even when the valve plate is opened to its fast-idle position. The second port is exposed to the substantially atmospheric pressure when the valve plate is further opened from the fast-idle position. The heat-sensitive valve means is open while the engine is cold, and closed when the engine is warmed up above a lower limit. With the valve plate in a position other than the fast-idle position while the engine is cold, the substantially atmospheric pressure is applied to the advance unit whereby the ignition timing is retarded permitting efficient warm-up of the engine and the catalyst. While the valve plate is in its fast-idle position and while the engine is cold, the vacuum developed in the intake passage is applied to the advance unit whereby the ignition timing is advanced permitting a smooth fast-idling of the engine.

10 Claims, 2 Drawing Figures

IGNITION TIMING CONTROL SYSTEM FOR AN INTERNAL-COMBUSTION ENGINE

BACKGROUND OF THE INVENTION

The present invention relates generally to an ignition timing control system for an internal-combustion engine wherein partial vacuum developed in an intake passage of the engine is applied to a vacuum advance unit connected to a distributor. More particularly, the invention is concerned with such ignition timing control system wherein the ignition timing while the engine is under cold fast-idle conditions is advanced thereby preventing unstable running or stall of the engine, but while the throttle valve is in a position other than the fast-idle position the timing is retarded thereby permitting efficient warm-up of the engine and catalyst.

It is recognized in the art that retarding the ignition timing while the engine is cold will raise the exhaust gas temperature and expedite a warm-up of the engine and the catalyst in the exhuast pipe. In view of this recognition, there has been proposed an ignition timing control system wherein the temperature of the engine is detected and the ignition timing is retarded while the detected temperature of the engine is below a predetermined lower limit. In such a control system, however, the ignition timing is retarded as long as the engine is cold, irrespective of the operating positions of the throttle valve. This system is disadvantageous, particularly in that the engine may slow down or even stall during a cold fast-idle operation with the throttle valve plate set in the fast-idle position at which the valve is kept a little more open than at a usual idle position so as to allow an engine idle under cold conditions.

SUMMARY OF THE INVENTION

This invention is intended to overcome these disadvantages. It is accordingly an object of the invention to provide an ignition timing control system for an internal-combustion engine which expedites a warm-up of the engine and the catalyst during a cold operation, and at the same time permits a smooth and stable fast-idling of the engine while it is cold.

To attain the above object, the ignition timing control system according to this invention comprises: a throttle valve plate received within an intake passage of the engine; a first port formed in the wall of the intake passage such that the first port is located upstream of the valve plate and exposed to the substantially atmospheric pressure while the valve plate remains in its idle position, the first port being exposed to vacuum developed in the intake passage when the valve plate is opened from the idle position; a second port formed in the wall of the intake passage such that the second port is kept located downstream of the valve plate and exposed to the vacuum even when the valve plate is opened to its fast-idle position, the second port being exposed to the substantially atmospheric pressure when the valve plate is further opened from the fast-idle position; connecting means for connecting the first and second ports with a vacuum advance unit connected to a distributor of the engine; and heat-sensitive valve means disposed in the connecting means between the second port and the vacuum advance unit. The valve means detects the temperature of the engine, and is kept open while the detected temperature of the engine is below a predetermined lower limit and closed when the engine is warmed up above the lower temperature limit.

The advantages offered by this invention are mainly that the substantially atmospheric pressure from the second port is applied to the vacuum advance unit through the heat-sensitive valve means when the valve plate is in a position other than the fast-idle position while the engine is cold, whereby the ignition timing is retarded permitting to expedite a warm-up of the engine and the catalyst, and that the vacuum from the first or second port is applied to the advance unit while the valve plate is in its fast-idle position, whereby the ignition timing is advanced even while the engine is cold thereby permitting a smooth and stable fast-idling and preventing an otherwise possible stall of the engine under such running conditions.

DETAILED DESCRIPTION OF THE PREFERRED EMBODIMENT

There will be described in detail the present invention with reference to the accompanying drawings illustrating specific embodiments of an ignition timing control system of the invention.

Figure 1:
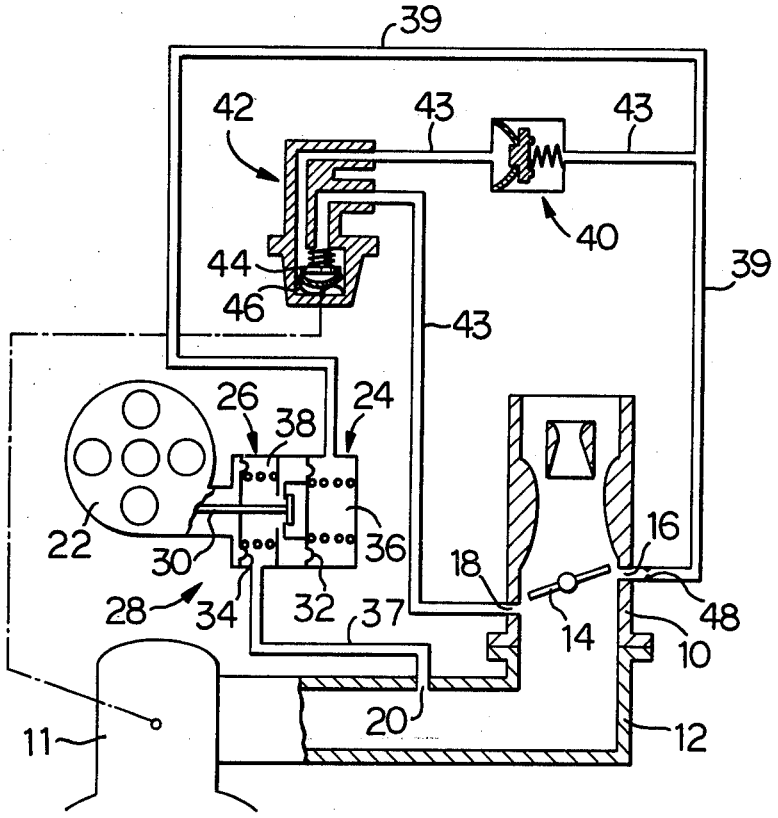
FIG. 1 is a schematic view illustrating the arrangement of an ignition timing control system in one form of this invention.

Referring first to FIG. 1, numeral 10 designates a carburetor which forms a portion of an intake passage communicated with an internal-combustion engine 11. There is connected to the carburetor 10 an intake manifold 12. Within the carburetor 10, is provided a well-known throttle valve plate 14. There are formed in the wall of the carburetor 10: a first port 16 which is located upstream of the throttle valve plate 14 and exposed to the substantially atmospheric pressure while the valve plate 14 remains in its idle position but exposed to vacuum developed in the intake passage when the valve plate 14 is opened from the idle position; and a second port 18 which is located downstream of the valve plate 14 and exposed to the vacuum even when the valve plate 14 is set to its fast-idle position but exposed to the substantially atmospheric pressure when the valve plate 14 is further opened from the fast-idle position. In the wall of the intake manifold 12 is provided a vacuum port 20 which is always exposed to the vacuum in the intake passage.

A distributor 22 is provided with a vacuum advance assembly 28 which consists of a primary advance unit 24 and a secondary advance unit 26. The housing of the vacuum advance assembly 28 accommodates an outer primary diaphragm 32 and an inner secondary diaphragm 34 which are connected to the distributor 22 by a connection member 30 so that the ignition timing of the distributor is adjusted. The connection member 30 extending from the distributor 22 is connected at one end thereof to the primary diaphragm 32 with a certain amount of axial play. The secondary diaphragm 34 is fixed to an intermediate portion of the connection member 30. The primary and secondary diaphragms 32 and 34 are biased by respective springs in a direction that causes the ignition timing of the distributor to be retarded, and define a primary and a secondary air-tight diaphragm chamber 36, 38, respectively, within the housing of the advance assembly 28. The secondary diaphragm chamber 38 is connected to the vacuum port 20 with a conduit 37. The primary diaphragm chamber 36 is connected to the first port 16 with a conduit 39. The primary diaphragm chamber 36 is further connected to the second port 18 with a conduit 43 which is connected to the second port 18 at one end and to the conduit 39 at the other end. There are provided between the ends of the conduit 43 a check valve 40, and a heat-sensitive switch valve 42 designed as heat-sensitive valve means and connected in series to the check valve 40.

The check valve 40 permits a flow of fluid therethrough toward the primary diaphragm chamber 36 but blocks the flow toward the second port 18. The heat-sensitive switch valve 42 is mounted, for example, on the engine block of the internal-combustion engine 11, to sense the temperature of the engine 11. The switch valve 42 is open as long as the engine is cold, i.e., the valve is closed when the engine is warmed up above a predetermined lower limit. More specifically, the heat-sensitive switch valve 42 has two connection ports and a passage connecting the two ports, and comprises a valve poppet 44 which opens and closes the passage, and a bimetallic strip 46 which is bent or curled with a snap action into concave or convex shape, causing the poppet 44 to be operated according to the sensed temperature of the engine 11. Adjacent to the first port 16, there is provided a flow limiter or choke 48 which restricts a flow of fluid through the first port 16.

There will be described the operation of the ignition timing control system of the present embodiment.

While the engine 11 is warm or at normal operating temperature and the heat-sensitive switch valve 42 is in the closed position, the primary advance unit 24 is kept under the vacuum applied from the first port 16, whereby the ignition timing of the engine 11 is controlled in a well-known manner according to the magnitude of the vacuum developed within the intake passage. In more detail, when the throttle valve plate 14 remains in its idle position, the first port 16 is located upstream of the throttle valve plate 14 and consequently atmospheric pressure is applied to the primary advance unit 24. In this condition, the ignition timing of the engine 11 is controlled mainly by the secondary advance unit 26. When the throttle valve plate 14 is opened from its idle position, the first port 16 is exposed to the vacuum whose level is determined by the running speed and load condition of the engine 11, and the primary advance unit 24 is subject to such level of vacuum. Thus, the ignition timing of the engine is controlled in response to the running conditions of the engine.

While the engine is cold, on the other hand, the heat-sensitive switch valve 42 remains in its open position, and the throttle valve plate 14 is set in a fast-idle position, for example, by an automatic choke mechanism even when the accelerator pedal is not operated. When the valve plate 14 is in this fast-idle position, i.e., the plate 14 is slightly open from the idle position, the first and second ports 16 and 18 are both located downstream of the plate. The valve plate 14 shown in FIG. 1 is set in the fast-idle position.

With the valve plate 14 set in the fast-idle position, the first and second ports 16 and 18 are exposed to a substantially equal level of vacuum in the intake passage but the vacuum is applied to the primary advance unit 24 through only the first port 16 because the check valve 40 prevents application of the vacuum to the unit 24 through the second port 18. The vacuum application to the primary advance unit 24 through the first port 16 causes the primary diaphragm 32 to be moved against the resilient force of its biasing spring thereby advancing the ignition timing of the engine and increasing the number of revolution thereof. Thus, the engine at the fast-idle is run in smooth and stable conditions.

When the throttle valve plate 14 is further opened, the second port 18 becomes located upstream of the valve plate 14 and exposed to the substantially atmospheric pressure which is now applied to the primary advance unit 24 through the heat-sensitive switch valve 42 and the check valve 40, whereby the ignition timing of the engine 11 is retarded. Although the atmospheric pressure through the second port 18 is applied toward the first port 16, the atmospheric flow into the intake passage through the first port 16 is restricted by the choke 48 disposed adjacent to the port 16. In other words, the vacuum output from the first port 16 is limited and therefore the primary advance unit 24 is operated substantially by the atmospheric pressure applied from the second port 18. Thus, the choke 48 acts to retard the ignition timing.

It is noted here that when the throttle valve plate 14 is returned to its idle position before the heat-sensitive switch valve 42 is closed, the check valve 40 will prevent the vacuum from being applied from the second port 18 to the primary advance unit 24 and as a result, the unit 24 is subjected only to the atmospheric pressure from the first port 16, whereby the advanced ignition timing of the engine is retarded by the primary advance unit 24.

As described above, the ignition timing control system according to the preferred embodiment provides a solution to the conventional problem of unstable running of the engine with the throttle valve plate 14 in the fast-idle position while the engine is cold. In other words, the present control system permits a smooth and stable operation by advancing the ignition timing under such cold fast-idle conditions. Further, while the throttle valve plate 14 is in a position other than the fast-idle position the ignition timing is retarded and accordingly the engine and the catalyst are warmed up efficiently.

Figure 2:
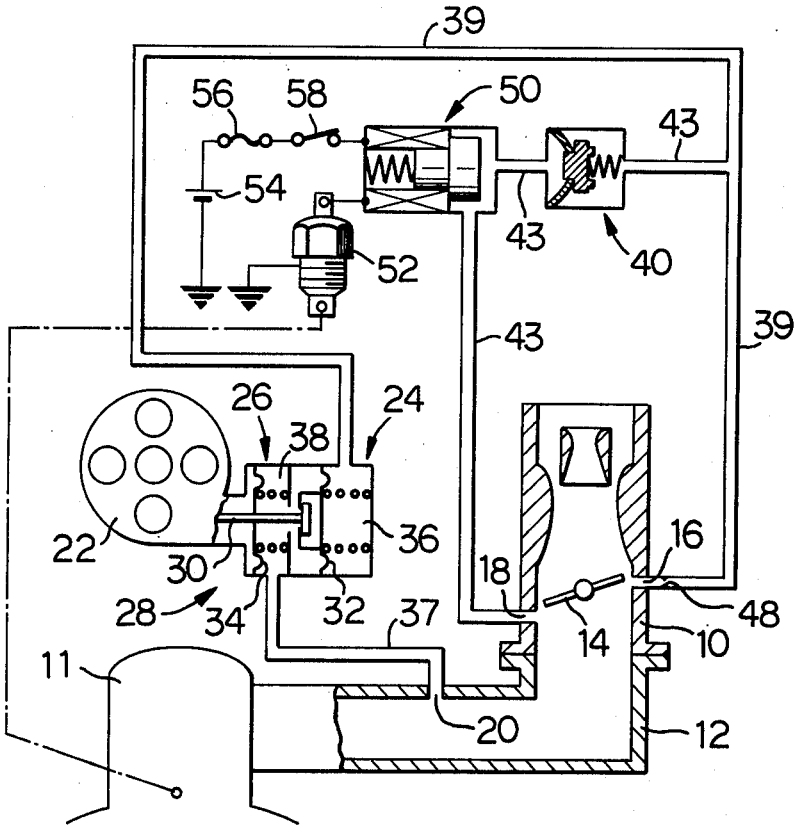
FIG. 2 is a schematic view similar to FIG. 1 showing another form of the ignition timing control system of the invention.

Referring now to FIG. 2, there is schematically shown another preferred embodiment of an ignition timing control system of this invention, wherein the same reference numerals are given to those elements which are also used in the previous embodiment. The description of such elements is omitted.

There are shown in FIG. 2 an electromagnetic switch valve 50 and a thermal switch 52 which are employed in place of the previously described heat-sensitive switch valve 42. The electromagnetic switch valve 50 which is interposed in the conduit 43 between the check valve 40 and the second port 18, is constructed such that it opens and closes the conduit 43 when it is energized and deenergized, respectively. The thermal switch 52 which is mounted on the engine block of the engine 11 to detect the temperature thereof, is closed when the detected temperature is below a predetermined level and opened when the temperature rises above that level. The electromagnetic switch valve 50 and the thermal switch 52 are electrically connected in series with a battery 54. While the engine 11 is cold and the thermal switch 52 is closed, the electromagnetic switch valve 50 is energized and remains open. When the temperature of the engine 11 rises above the predetermined level during the warm-up process, the thermal switch 52 is turned to its open position causing the electromagnetic switch valve 50 to be deenergized and closed. Numerals 56 and 58 designate a fuse and an ignition switch which are connected in series with the battery 54, like the thermal switch 52 and the electromagnetic switch 50.

According to this modified embodiment, the electromagnetic switch valve 50 need not to be mounted close to the engine 11 to detect the temperature and thus the conduit 43 connecting the second port and the primary advance unit 24 may be shortened. With this short piping arrangement, the instant ignition timing control system offers an advantage of improved response to varying running conditions of the engine.

Although the invention has been described in its preferred embodiments with reference to the drawings, it may be embodied in other forms.

For example, the heat-sensitive switch valve 42 and the thermal switch 52 which are mounted on the engine block in the previous embodiments, may be disposed adjacent to an oil pan or exhaust pipe to detect the temperature of lubricant or exhaust gas, or at other similar locations where the temperature of the engine 11 may be sensed.

As another example, a flow limiter similar to the previously indicated choke 48 may be additionally provided in the conduit 43 so that when the throttle valve plate 14 is further opened from the fast-idle position while the engine 11 is cold, the atmospheric pressure acting on the second port 18 is applied to the primary advance unit 24 through the additional flow limiter which serves, together with the choke 48, to regulate an amount of retard of the ignition timing during an operation of the engine under such conditions. Without such additional limiter and the choke 48, however, the level of the vacuum applied through the first port 16 to the primary diaphragm chamber 36 is greatly reduced from that of the vacuum within the intake manifold 12 by means of the atmospheric pressure output from the second port 18, and therefore the ignition timing can still be controlled in a retarding direction.

In the case where the check valve 40 is not provided, and when the throttle valve plate 14 is returned to the idle position from the fast-idle position while the engine is cold, the atmospheric pressure output from the first port 16 to the primary diaphragm chamber 36 is reduced to partial vacuum by the vacuum output from the second port 18, i.e., the vacuum of a lower level than the vacuum within the intake manifold 12 is applied to the diaphragm chamber 36, whereby the ignition timing can still be controlled in a retarding direction.

As a further example, the bimetallic strip 46 may be replaced by other heat-sensitive actuating means such as a thermal-wax unit to move the valve poppet 44 between the open and closed positions within the heat-sensitve switch valve 42.

It is needless to say that the throttle valve plate 14, first port 16 and second port 18 which are provided in the carburetor 10 in the preceding embodiments, may be disposed in an intake passage having no carburetor when the fuel is directly injected into the intake passage.

It is further understood that the foregoing description is related to the preferred form of this invention and that various changes and modifications may be made without departing from the spirit and scope of the invention.

What is claimed is:

1. An ignition timing control system for an internal-combustion engine wherein vacuum developed in an intake passage to the engine is applied to a vacuum advance unit connected to a distributor, said ignition timing control system comprising:

a throttle valve plate pivotally received within said intake passage;

a first port formed in the wall of said intake passage such that said first port is located upstream of said valve plate and exposed to the substantially atmospheric pressure while said valve plate remains in its idle position, said first port being exposed to said vacuum when said valve plate is opened from said idle position;

a second port formed in the wall of said intake psssage such that said second port is kept located downstream of said valve plate and exposed to said vacuum even when said valve plate is set to its fast-idle position, said second port being exposed to the substantially atmospheric pressure when said valve plate is further opened from said fast-idle position;

connecting means for connecting said first and second ports with said vacuum advance unit; and heat-sensitive valve means disposed in said connecting means between said second port and said vacuum advance unit, said valve means sensing the temperature of said engine and being closed when the engine is warmed up above a lower temperature limit, whereby the ignition timing is advanced by said vacuum advance unit when said throttle valve plate is in the fast-idle position even while the engine is cold.

2. A system as recited in claim 1, wherein said heat-sensitive valve means is a thermal switch valve having two connecting ports, a passage connecting said two connection ports, a valve poppet disposed in said passage to open and close the same, and a bimetal operating said valve poppet, said passage being closed by said valve poppet when the temperature of the engine exceeds said lower limit.

3. A system as recited in claim 1, wherein said heat-sensitive valve means comprises a thermal switch activated when the temperature of the engine exceeds said lower limit, and an electromagnetic switch valve which is closed when said thermal switch is activated.

4. A system as recited in claim 1, 2 or 3, further comprising a choke disposed in either one of said first port and a portion of said connecting means adjacent said first port, said choke restricting a flow of said vacuum through said first port when said throttle valve plate is opened from said fast-idle position while the engine is cold.

5. A system as recited in any one of claims 1–3, further comprising a check valve connected in series with said heat-sensitive valve means, said check valve blocking a flow of fluid toward said second port when said throttle valve plate is returned to its idle position while the engine is cold.

6. A system as recited in any one of claims 1–3, wherein said vacuum advance unit comprises a primary and a secondary diaphragm chamber, said primary diaphragm chamber communicating with said first and second ports, and said intake passage further comprises a third port which is located downstream of said throttle valve plate and always exposed to said vacuum, said third port communicating with said secondary diaphragm chamber to apply said vacuum to the latter.

7. A system as recited in any one of claims 1–3, wherein said throttle valve plate is disposed in a carburetor which forms a portion of said intake passage.

8. In combination, an intake manifold for an engine;

a throttle valve plate in said manifold for movement between an idle position relative to said manifold, an open position permitting a throttled flow of air through said manifold and a fast idle position between said idle position and said open position;

a distributor having a movable member for adjusting ignition timing and at least one advance unit for moving said member;

a first port in said intake manifold located upstream of said throttle valve plate in said idle position of said plate and downstream of said plate in said first idle position;

a first conduit connecting said first port with said primary advance unit;

a second port in said intake manifold located downstream of said throttle valve plate in said idle position and said fast idle position of said plate and upstream of said plate in said open position of said plate;

a second conduit connecting said second port with said first conduit; and a heat sensitive switch valve in said second conduit for selectively closing said second conduit in response to a heated condition of the engine.

9. In combination, an intake manifold for an engine;

a throttle valve plate in said manifold for movement between an idle position relative to said manifold, an open position permitting a throttled flow of air through said manifold and a fast idle position between said idle position and said open position;

a distributor having a movable member for adjusting ignition timing, a primary advance unit for moving said member and a secondary advance unit for moving said member;

a first port in said intake manifold located upstream of said throttle valve plate in said idle position of said plate and downstream of said plate in said fast idle position;

a first conduit connecting said first port with said primary advance unit;

a second port in said intake manifold located downstream of said throttle valve plate in said idle position and said fast idle position of said plate and upstream of said plate in said open position of said plate;

a second conduit connecting said second port with said first conduit;

a heat sensitive switch valve in said second conduit for selectively closing said second conduit in response to a heated condition of the engine;

a third port in said intake manifold located downstream of said throttle valve plate in said idle position, said fast idle position and said open position of said plate; and a third conduit connecting said third port with said secondary advance unit whereby, with said plate in said fast idle position, said first port delivers a vacuum to said primary advance unit to move said member to advance the ignition timing.

10. The combination as set forth in claim 9 further comprising a non-return check valve connected in series with said switch valve in said second conduit to close said second conduit to a flow from said first conduit.

* * * * *